US008118339B2

(12) United States Patent
Knudson

(10) Patent No.: US 8,118,339 B2
(45) Date of Patent: Feb. 21, 2012

(54) PVC PRIMER AND GLUE CAN CADDY

(76) Inventor: Douglas John Knudson, Olivia, MN (US)

( * ) Notice: Subject to any disclaimer, the term of this patent is extended or adjusted under 35 U.S.C. 154(b) by 86 days.

(21) Appl. No.: 12/782,966

(22) Filed: May 19, 2010

(65) Prior Publication Data

US 2010/0294817 A1 Nov. 25, 2010

Related U.S. Application Data

(60) Provisional application No. 61/179,926, filed on May 20, 2009.

(51) Int. Cl.
*A45F 5/00* (2006.01)

(52) U.S. Cl. ..... 294/162; 294/165; 224/148.6

(58) Field of Classification Search ..... 294/154, 294/159, 160, 162, 163, 165; 206/143, 162, 206/175, 199, 562; 224/148.6
See application file for complete search history.

(56) References Cited

U.S. PATENT DOCUMENTS

| | | | | | |
|---|---|---|---|---|---|
| 2,460,530 | A | * | 2/1949 | Petyak | 294/159 |
| 2,625,308 | A | * | 1/1953 | Green | 294/159 |
| 3,693,830 | A | * | 9/1972 | Oglesbee | 206/162 |
| 3,913,778 | A | * | 10/1975 | Oglesbee | 294/159 |
| 4,294,481 | A | * | 10/1981 | Pearl | 294/146 |
| 4,624,496 | A | * | 11/1986 | Bengtson | 294/165 |
| D372,842 | S | * | 8/1996 | Cleary et al. | D7/600 |

* cited by examiner

*Primary Examiner* — Paul T Chin
(74) *Attorney, Agent, or Firm* — Michael Ries

(57) ABSTRACT

A PVC primer and glue can caddy for carrying and keeping together a can of PVC primer and a can of glue comprises horizontal base with two circular shaped indentures to accommodate the cans, a vertical stand with a handle and two slit shaped apertures. The caddy also has a strap with a hook portion and a loop portion that is slid through the slit apertures forming a closed loop attachment for the cans while placed in the circular indentures and a recessed screw is also provided for attaching the horizontal base to the vertical stand.

6 Claims, 2 Drawing Sheets

PVC PRIMER AND GLUE CAN CADDY

This application claims priority to U.S. Provisional Application 61/179,926 filed on May 20, 2009, the entire disclosure of which is incorporated by reference.

TECHNICAL FIELD & BACKGROUND

The present invention generally relates to a caddy to hold cans. More specifically, the invention is a caddy to hold and carry a can of PVC primer and a can of glue together.

It is an object of the invention to provide a caddy that holds a can of PVC primer and a can of glue together.

It is an object of the invention to provide a caddy that allows a can of PVC primer and a can of glue to be carried together.

What is really needed is a caddy that easily allows a can of PVC primer and a can of glue to be held and carried together for greater convenience and ease of use.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
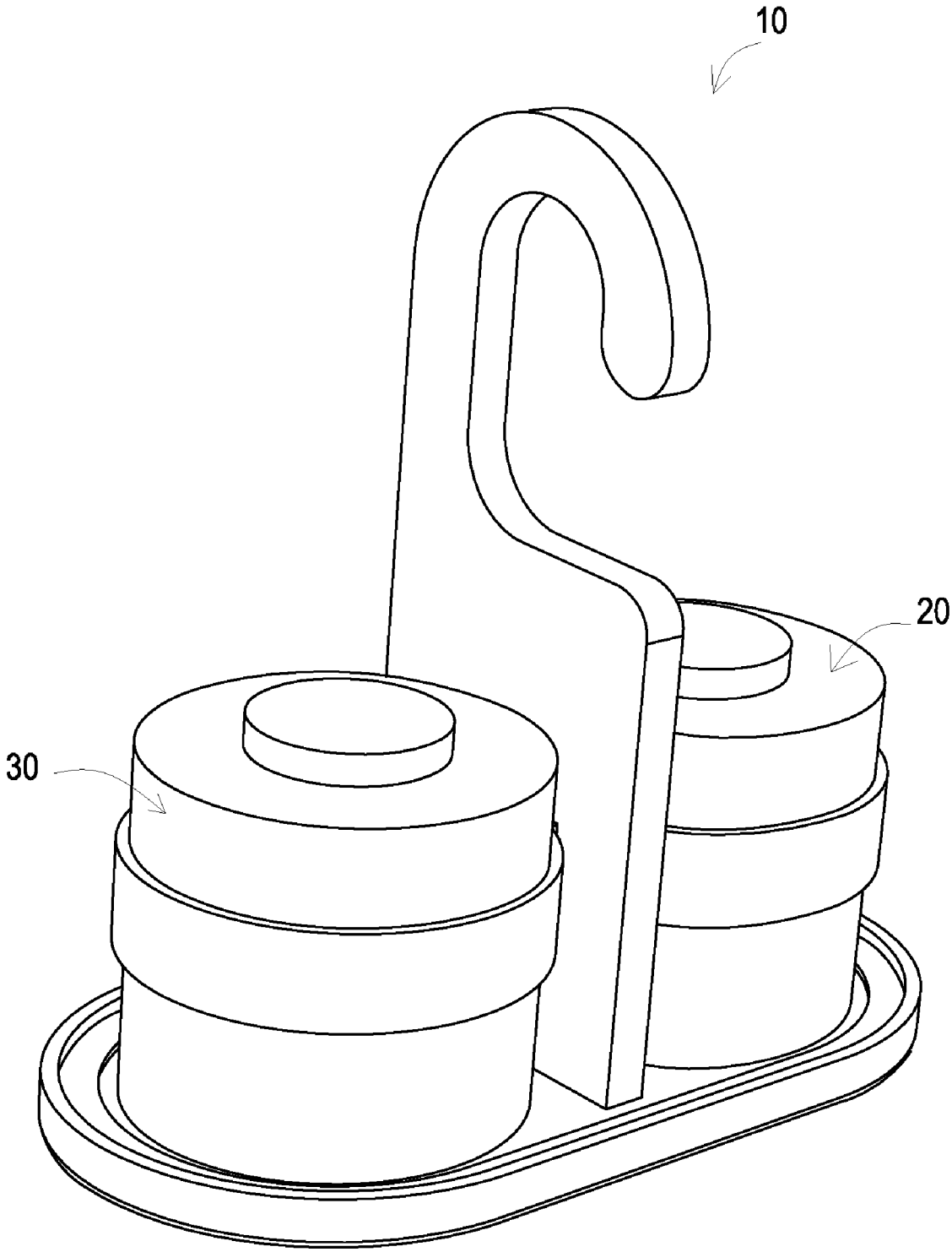
FIG. 1 illustrates a diagonal side environmental perspective view of a PVC primer and glue can caddy, in accordance with one embodiment of the present invention.

FIG. 1 illustrates a diagonal side environmental perspective view of a PVC primer and glue can caddy 10, in accordance with one embodiment of the present invention. The PVC primer and glue can caddy 10 is used for carrying and keeping together a can of PVC primer 20 and a can of glue 30. The PVC primer and glue can caddy 10 illustrated in FIG. 1 does not illustrate a strap, which is illustrated and described in the FIG. 2 description.

Figure 2:
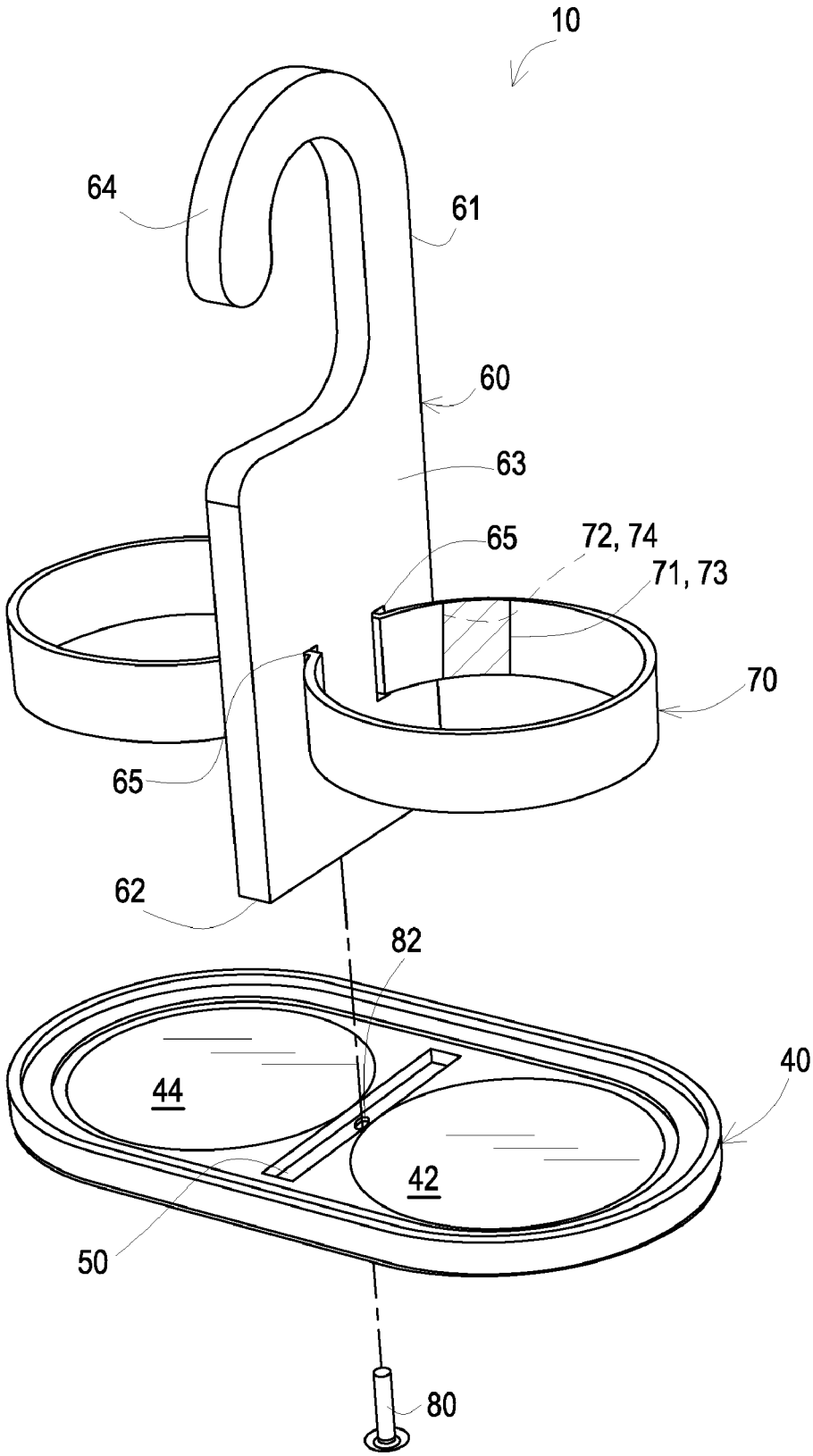
FIG. 2 illustrates an exploded diagonal side perspective view of a PVC primer and glue can caddy, in accordance with one embodiment of the present invention.

FIG. 2 illustrates an exploded diagonal side perspective view of a PVC primer and glue can caddy 10, in accordance with one embodiment of the present invention. The PVC primer and glue can caddy 10 has a horizontal base 40 with a first circular shaped indenture 42 and a second circular shaped indenture 44 to accommodate the PVC primer can 20 and the glue can 30 with a thin rectangular shaped indenture 50 disposed between the first and second circular indentures 42,44. The PVC primer can 20 can be put into either the first circular indenture 42 or the second circular indenture 44 and the glue can 30 can also be put into either the first circular indenture 42 or the second circular indenture 44. If the PVC primer can 20 is put into the first circular indenture 42 then the glue can 30 must be put into the second circular indenture 44 and if the glue can 30 is put into the first circular indenture 42 then the PVC primer can 20 must be put into the second circular indenture 44. There is also a vertical stand 60 with a distal end 61, a proximal end 62 and a middle section 63 where the proximal end 62 is perpendicularly inserted into the rectangular indenture 50 and a handle 64 is disposed on the distal end 61 and the middle section 63 has two slit shaped apertures 65. The handle 64 has a general hook shape but can be any shape for grasping and hanging that is well known to those schooled in the art.

There is also a strap 70 with a first end 71 and a second end 72 with a hook portion 73 on the first end 71 and a loop portion 74 on the second end 72, the strap 70 is slid through both slit apertures 65 and the loop portion 74 is attached to the hook portion 73 forming a closed loop attachment (no number) for the PVC can 20 and the glue can 30 while placed in the circular indentures 42, 44. The hook portion 73 can also be separated from the loop portion 74 of the closed loop attachment to release the cans 20, 30 by simply pulling both ends 71, 72 apart. There is also a means for attaching the inserted proximal end 62 into the rectangular shaped indenture 50, which is a recessed screw 80, however any other means for attaching that are well known in the art, such as a rivet, a bolt or an ordinary screw can also be used. The recessed screw 80 enters the proximal end of the vertical stand 62 through an aperture 82 on the rectangular shaped indenture 50 for attachment.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A PVC primer and glue can caddy for carrying and keeping together a can of PVC primer and a can of glue, comprising:

a horizontal base with a first circular shaped indenture and a second circular shaped indenture to accommodate said PVC primer can and said glue can with a thin rectangular shaped indenture disposed between said first and second circular indentures;

a vertical stand with a distal end, a proximal end and a middle section where said proximal end is perpendicularly inserted into said rectangular indenture, a handle is disposed on said distal end and said middle section has two slit shaped apertures;

a strap with a first end and a second end with a hook portion on said first end and a loop portion on said second end, said strap is slid through both said slit apertures and said loop portion is attached to said hook portion forming a closed loop attachment around said PVC can and said glue can while placed in said circular indentures; and a means for attaching said inserted proximal end onto said rectangular shaped indenture.

2. The caddy according to claim 1, wherein said handle has a general hook shape.

3. The caddy according to claim 1, wherein said hook portion can be separated from said loop portion of said closed loop to release said cans.

4. The caddy according to claim 3, wherein said closed loop is released by pulling apart said first end from said second end.

5. The caddy according to claim 1, wherein said means for attaching is a recessed screw.

6. The caddy according to claim 5, wherein said screw enters said proximal end of vertical stand through an aperture on said rectangular shaped aperture.

* * * * *